US011131048B2

(12) United States Patent
White et al.

(10) Patent No.: US 11,131,048 B2
(45) Date of Patent: Sep. 28, 2021

(54) METHOD AND APPARATUS FOR CLEANING LAUNDRY

(71) Applicant: Electrolux Home Products, Inc., Charlotte, NC (US)

(72) Inventors: Allison White, Charlotte, NC (US); Martino Bondi, Charlotte, NC (US); Yihong Li, Charlotte, NC (US); Elisa Stabon, Charlotte, NC (US); Alberto Lucchetta, Charlotte, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 308 days.

(21) Appl. No.: 16/131,941

(22) Filed: Sep. 14, 2018

(65) Prior Publication Data

US 2020/0087828 A1 Mar. 19, 2020

(51) Int. Cl.

| | |
|---|---|
| ***D06F 33/00*** | (2020.01) |
| ***D06F 39/02*** | (2006.01) |
| ***D06F 39/08*** | (2006.01) |
| ***D06F 37/04*** | (2006.01) |
| ***D06F 39/10*** | (2006.01) |
| ***D06F 37/30*** | (2020.01) |
| ***D06F 23/02*** | (2006.01) |
| ***D06F 34/18*** | (2020.01) |
| *D06F 35/00* | (2006.01) |

(52) U.S. Cl.

CPC ..... *D06F 33/00* (2013.01); *D06F 23/02* (2013.01); *D06F 34/18* (2020.02); *D06F 37/04* (2013.01); *D06F 37/304* (2013.01); *D06F 39/02* (2013.01); *D06F 39/028* (2013.01); *D06F 39/088* (2013.01); *D06F 39/10* (2013.01); *D06F 35/006* (2013.01); *D06F 35/007* (2013.01); *D06F 2202/04* (2013.01); *D06F 2202/10* (2013.01); *D06F 2210/00* (2013.01); *D06F 2212/02* (2013.01); *D06F 2222/00* (2013.01); *D06F 2224/00* (2013.01)

(58) Field of Classification Search

None

See application file for complete search history.

(56) References Cited

U.S. PATENT DOCUMENTS 8,108,959 B2 * 2/2012 Park ..... D06F 35/008 8/149.3

8,931,311 B2 1/2015 Leibman et al.

(Continued)

*Primary Examiner* — Cristi J Tate-Sims

(74) *Attorney, Agent, or Firm* — RatnerPrestia

(57) ABSTRACT

A method for controlling a laundry washing machine. The method includes: performing a tub loading process comprising operating supply valve(s) to provide a first volume of water through a detergent supply system and into a tub to fill the tub with wash liquid; performing a washing process comprising rotating a drum to agitate laundry in the presence of the wash liquid; performing a static rinsing process comprising operating a pump to remove any free volume of wash liquid from the tub without rotating the drum; and performing one or more rinsing processes comprising: operating the supply valve(s) to provide a volume of clean rinse water to the tub, operating the pump to remove the rinse water from the drum, and operating the motor to spin the drum at high speed to extract rinse water from the laundry, while continuing to operate the pump.

8 Claims, 3 Drawing Sheets

(56) References Cited

U.S. PATENT DOCUMENTS

| | | | | |
|---|---|---|---|---|
| 9,637,857 | B2 | 5/2017 | Del Pos et al. | |
| 2004/0143907 | A1* | 7/2004 | Musser | D06F 39/08 8/158 |
| 2010/0064448 | A1* | 3/2010 | Im | D06F 35/006 8/159 |
| 2017/0254011 | A1* | 9/2017 | Kweon | D06F 39/087 |

* cited by examiner

METHOD AND APPARATUS FOR CLEANING LAUNDRY

TECHNICAL FIELD

The present invention concerns the field of laundry washing techniques, and particularly to methods and apparatuses for addressing large amounts of soil and solid soil.

BACKGROUND

The use of automated laundry washing machines is widespread. Such machines include both relatively simple laundry washing machines that can only wash and rinse laundry, and more complex laundry washing machines that can also dry laundry. The term "laundry washing machine" is used herein to refer to both types of laundry washing machine, and other laundry washing machines as may be known or later made available.

Laundry washing machines typically use a liquid solution to help remove soil from fabrics. The liquid solution usually is water-based, and may comprise water alone, or water mixed with additives (e.g., detergent, fabric softener, bleach, etc.). The cleaning solution may be provided at a variety of different temperatures.

A laundry washing machine typically includes a tub configured to receive and hold the cleaning solution and a drum rotatably mounted inside the tub to receive and hold fabric laundry products, such as clothing, bed sheets and other linens, curtains, and the like. The drum is perforated or otherwise configured to allow cleaning solution to pass between the tub and the drum. In "front-loading" washing machines, the drum rotates on a horizontal or nearly horizontal axis, and the cleaning solution is provided in the lower end of the tub, and as the drum rotates, the laundry is repeatedly raised and lowered into an out of the cleaning solution. In "top-loading" washing machines, the drum rotates on a vertical or nearly vertical axis, and the cleaning solution is provided, during the wash phase, at a level that the laundry is immersed within the solution. The drum may be reciprocated back and forth to agitate the laundry and cleaning solution, or the drum may remain still while a separate agitator located inside the drum moves to perform the agitation.

The laundry washing machine may have a number of operation programs, which may be selected by the user or selected automatically based on detected conditions (e.g., load weight). In a typical wash phase, the laundry washing machine may determine the amount of wash water and rinse water according to a user's selection of a particular washing program, and then proceed to supply the appropriate amount of cleaning solution to the tub, operate the drum, and otherwise control the laundry washing machine components to execute the selected washing program.

At the end of the wash phase, the laundry washing machine typically performs one or more intermediate spin cycles during which the drum is rotated at a high speed one or more times for extracting the cleaning solution from the laundry. The cleaning solution is drained from the washing tub by activating a draining pump before, during and/or after one or more of these intermediate spin cycles.

Next, the washing machine typically starts a rinse phase in which a suitable amount of clean water is provided to the tub to rinse any remaining cleaning solution from the laundry, and the drum (and/or agitator) is rotated to help dilute and remove the remaining cleaning solution.

At the end of the rinse phase, the laundry washing machine typically performs one or more final spin cycles to remove the water and any diluted cleaning solution from the laundry. The water and diluted cleaning solution may be drained before, during and/or after one or more of the final spin cycles by operating the draining pump.

A typical laundry washing machine includes an electronic control system that is configured to perform the foregoing operations and other operations. The control system may include various user control inputs, logical programming to perform one or more operation programs, sensor feedback systems, and so on.

One typical optional operation program is a program intended to address the presence of a large amount of dirt in the laundry. Such operation programs go by a variety of names, such as "heavy soil," "extra cleaning," "solid soil," a "dirt" option, and so on. The inventors have determined that there is a need to provide alternatives to existing versions of such operation programs.

This description of the background is provided to assist with an understanding of the following explanations of exemplary embodiments, and is not an admission that any or all of this background information is necessarily prior art.

SUMMARY

In one exemplary aspect, there is provided a method for controlling a laundry washing machine having a tub, a drum rotatably mounted within the tub, a motor configured to selectively rotate the drum, one or more supply valves connectable to a water supply system, a detergent supply system and a water draining pump. The method includes: performing a tub loading process comprising operating the one or more supply valves to provide a first volume of water through the detergent supply system and into the tub to fill the tub with wash liquid; performing a washing process comprising operating the motor to rotate the drum to thereby agitate laundry in the drum in the presence of the wash liquid; performing a static rinsing process. The static rinsing process includes: operating the water draining pump to remove any free volume of wash liquid from the tub without operating the motor to spin or rotate the drum; and performing one or more rinsing processes. The one or more rinsing processes include: performing a tub loading process comprising operating the one or more supply valves to provide a volume of clean rinse water to the tub; operating the water draining pump to remove the rinse water from the drum; and operating the motor to spin the drum at high speed to extract rinse water from the laundry, while continuing to operate the draining pump.

The one or more rinsing processes further may also include operating the motor to rotate the drum after the step of performing the tub loading process and before the step of operating the water draining pump.

The one or more rinsing processes may include: performing a tub loading process comprising operating the one or more supply valves to provide a first volume of clean rinse water to the tub, the first volume being greater than a typical volume used for rinsing; operating the water draining pump to remove rinse water from the drum; operating the motor to spin the drum at high speed to extract rinse water from the laundry, while continuing to operate the draining pump; and performing a first further one or more rinsing, draining and spinning processes.

The one or more rinsing processes may include: performing a tub loading process comprising operating the one or more supply valves to provide a first volume of clean rinse water to the tub that is greater than a typical volume used for rinsing; operating the motor to rotate the drum and agitate the load for a period of time; operating the water draining pump to remove rinse water from the drum; operating the motor to spin the drum at high speed to extract rinse water from the laundry, while continuing to operate the draining pump; and performing a first further one or more rinsing, draining and spinning processes.

At least one of the one or more rinsing processes may include operating the one or more supply valves to provide a first volume of clean rinse water to the tub that is greater than a typical volume used for rinsing.

Operating the one or more supply valves to provide a first volume of water through the detergent supply system and into the tub to fill the tub with wash liquid may include mixing the wash liquid in a chamber before conveying the wash liquid to the tub.

Performing the tub loading process further may include operating the one or more supply valves to provide a second volume of water through the detergent supply system and into the tub to fill the tub and at least a portion of the drum with wash liquid.

The second volume of water may be hot water.

In another exemplary aspect, there is provided a laundry washing machine having: a tub; a drum rotatably mounted within the tub; a motor configured to selectively rotate the drum; one or more supply valves connectable to a water supply system; a detergent supply system; a water draining pump; and a control unit. The control unit is configured to: perform a tub loading process comprising operating the one or more supply valves to provide a first volume of water through the detergent supply system and into the tub to fill the tub with wash liquid; perform a washing process comprising operating the motor to rotate the drum to thereby agitate laundry in the drum in the presence of the wash liquid; perform a static rinsing process including operating the water draining pump to remove any free volume of liquid solution from the tub without simultaneously operating the motor to rotate the drum; and perform a one or more rinsing processes. The one or more rinsing processes include: performing a tub loading process comprising operating the one or more supply valves to provide a volume of clean rinse water to the tub; operating the water draining pump to remove the rinse water from the drum; and operating the motor to spin the drum at high speed to extract rinse water from the laundry, while continuing to operate the draining pump.

The control unit may be configured to perform the one or more rinsing processes by operating the motor to rotate the drum after the step of performing the tub loading process and before the step of operating the water draining pump.

The control unit may be configured to perform the one or more rinsing processes by: performing a tub loading process comprising operating the one or more supply valves to provide a first volume of clean rinse water to the tub that is greater than a typical volume used for rinsing; operating the water draining pump to remove rinse water from the drum; operating the motor to spin the drum at high speed to extract rinse water from the laundry, while continuing to operate the draining pump; and performing a first further one or more rinsing, draining and spinning processes.

The control unit may be configured to perform the one or more rinsing processes by: performing a tub loading process comprising operating the one or more supply valves to provide a first volume of clean rinse water to the tub that is greater than a typical volume used for rinsing; operating the motor to rotate the drum and agitate the load for a period of time; operating the water draining pump to remove rinse water from the drum; operating the motor to spin the drum at high speed to extract rinse water from the laundry, while continuing to operate the draining pump; and performing a first further one or more rinsing, draining and spinning processes.

The control unit may be configured to perform at least one of the one or more rinsing processes by operating the one or more supply valves to provide a first volume of clean rinse water to the tub, the first volume being greater than a typical volume used for rinsing.

The control unit may be configured to mix the wash liquid in a chamber before conveying the wash liquid to the tub.

The control unit may be configured to perform the tub loading process by operating the one or more supply valves to provide a second volume of water through the detergent supply system and into the tub to fill the tub and at least a portion of the drum with wash liquid.

The second volume of water may be hot water.

In another exemplary aspect, there is provided a laundry washing machine having: a tub; a drum rotatably mounted within the tub; a motor configured to selectively rotate the drum; a water draining pump; and a control unit, the control unit. The control unit is configured to: perform a first cleaning cycle and a second cleaning cycle. The first cleaning cycle includes: filling the tub with wash liquid, operating the motor to rotate the drum to agitate the contents of the drum in the wash liquid, operating the water draining pump to remove any free volume of liquid solution from the tub without simultaneously operating the motor to rotate the drum, filling the tub with a first volume of clean rinse water, operating the water draining pump to remove the rinse water from the drum, and operating the motor to spin the drum at high speed to extract rinse water from the laundry, while continuing to operate the draining pump. The second cleaning cycle includes: filling the tub with wash liquid, operating the motor to rotate the drum to agitate the contents of the drum in the wash liquid, operating the water draining pump to remove any free volume of liquid solution from the tub, operating the motor to rotate the drum, filling the tub with a second volume of clean rinse water, operating the water draining pump to remove the rinse water from the drum, and operating the motor to spin the drum at high speed to extract rinse water from the laundry, while continuing to operate the draining pump.

The second volume may be less than the first volume.

In at least one of the first cleaning cycle and the second cleaning cycle, the control unit may be configured to mix the wash liquid in a chamber before conveying the wash liquid to the tub.

In at least one of the first cleaning cycle and the second cleaning cycle, the control unit may be configured to fill the tub with a supplemental amount of wash liquid prior to operating the motor to rotate the drum to agitate the contents of the drum in the wash liquid, the supplemental amount of wash liquid being sufficient to at least a portion of the drum with wash liquid.

The supplemental amount of wash liquid may be hot water.

BRIEF DESCRIPTION OF THE DRAWINGS

Embodiments of the invention will now be described, strictly by way of example, with reference to the accompanying drawings, in which.

DESCRIPTION OF EXEMPLARY EMBODIMENTS

The exemplary embodiments described herein have been found to provide enhanced cleaning of laundry soiled with a relatively large amount of certain kinds of dirt. As used herein, "dirt" generically refers to any kind of undesirable foreign substance, but particular examples of certain kinds of dirt (e.g., clay, household dust, oil, mud, etc.) are also referenced without intending to limit the applicability or scope of embodiments of the inventions.

Exemplary embodiments are described in the context of certain laundry washing machines, as described below. However, it will be understood that embodiments of the inventions are not limited to the particular structures or features of the described laundry washing machines. On the contrary, embodiments of the inventions may be conveniently applied to other types of laundry cleaning equipment. Such modifications will be understood by persons of ordinary skill in the art in view of the teachings provided herein.

Figure 1:
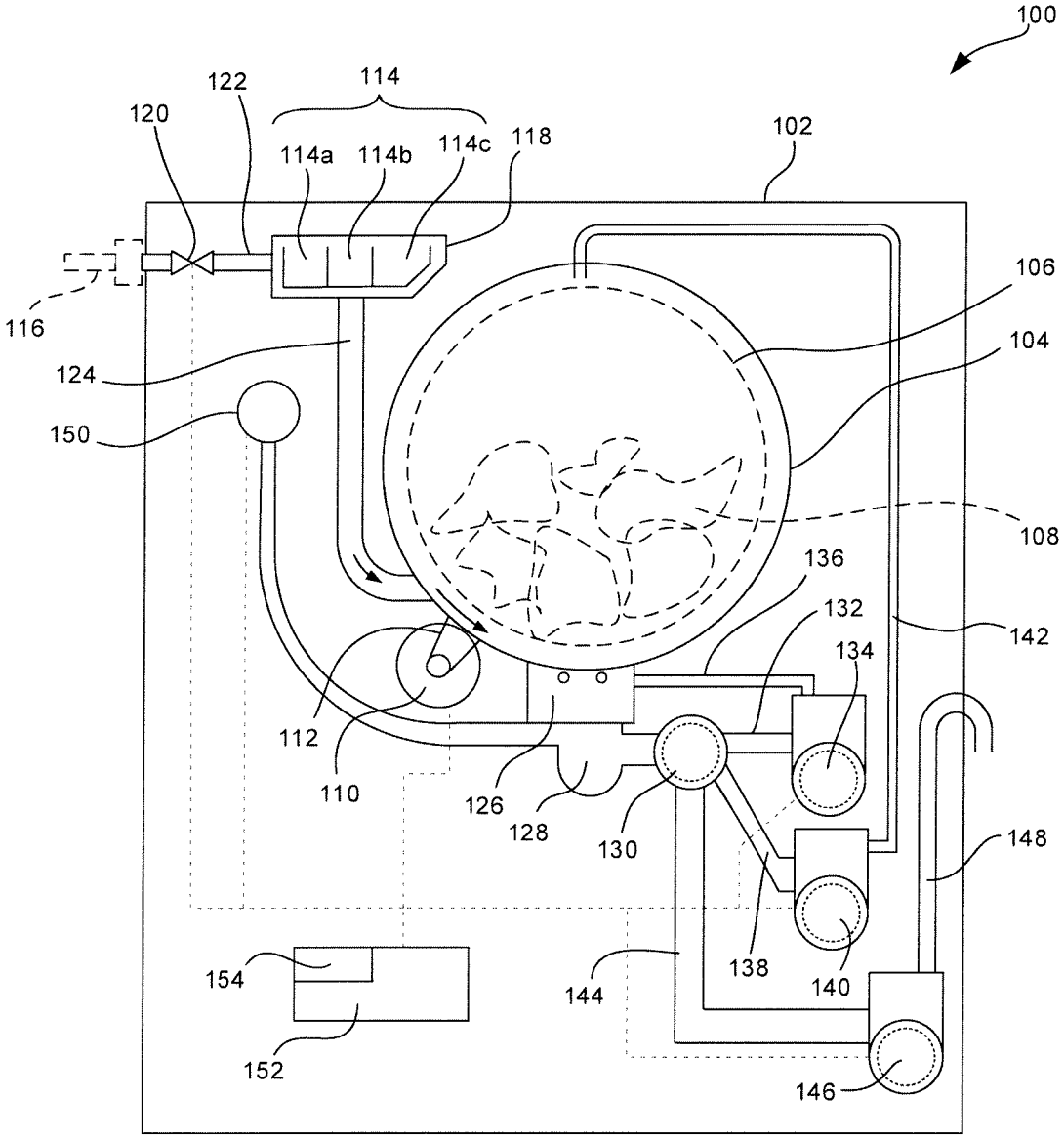
FIG. 1 is a schematic view of a laundry washing machine according to embodiments of the invention.

FIG. 1 schematically illustrates a laundry washing machine 100 of the front loading variety. Embodiments of the inventions herein have been found to be particularly successful when applied to a front loading laundry washing machine, but it is expected that similar successful results may be obtained when applied to top loading washing machines and combined washing and drying machines.

The laundry washing machine 100 has an external housing or casing 102, in which a washing tub 104 is provided. The washing tub 104 contains a rotatable perforated drum 106 in which laundry 108 to be washed can be loaded. The washing tub 104 and the drum 106 both preferably have a generally cylindrical shape, and the drum 106 may include various internally-projecting or externally-projecting lifters, agitators or wash-enhancing structures, as known in the art. The casing 102 includes a door (not illustrated) that allows access to the drum 106 for loading and unloading laundry 108. A bellows or seal (not shown) is provided around an open end of the tub 104 to form a water-tight seal with the casing 102 and the door, when the door is closed, as known in the art. The washing tub 104 is preferably suspended in a floating manner inside the casing 102, such as by a number of springs and shock-absorbers (not illustrated). The drum 106 may be rotated by an electric motor 110 that is operatively connected to the drum 106 by a belt and pulley system 112 or other power transmission mechanisms (e.g., gears, chains, etc.). In some cases, the motor 110 can be directly connected to the drum 106 by a common shaft.

The laundry washing machine 100 includes a detergent supply system 114 that is connectable to a water supply system 116, such as household hot and cold water taps. The detergent supply system 114 and water supply system 116 preferably are in the upper part of the laundry washing machine 100, but other locations are possible. The detergent supply system 114 and water supply system 116 are structured to supply water and washing/rinsing products, e.g., detergent, bleach, softener, etc., into the washing tub 104.

The detergent supply system 114 may include one or more compartments designed to be filled with washing and/or rinsing products. Such compartments may include, for example, a detergent compartment 114*a*, a bleach compartment 114*b*, and a fabric softener compartment 114*c*. The detergent compartment 114*a* may be configured to receive liquid detergent, powdered detergent and/or detergent contained in a dissolvable package or "pod." The compartments may be integrated into a movable drawer 118 or a removable container, or they may be fixed in place within the casing 102 and accessed through a door that provides a suitable opening through the casing 102. For example, the detergent supply system 114 may comprise a sliding drawer having separate compartments for detergent, bleach and softener.

The detergent supply system 114 also may be connected to one or more controllable supply valves 120 by one or more main inlet pipes 122. The supply valves 120 are selectively operable to provide hot and/or cold water to one or more of the compartments. Where multiple compartments are used, the supply valves 120 may be operated separately or simultaneously to dispense fluid into and through each compartment, either individually or in one or more groups. As the water provided by the water supply system 116 passes through the compartments, it becomes infused with the contents of the compartments, forming a liquid solution.

The water supply system 116 is connected to the washing tub 104 by one or more tub supply pipes 124. For example, the tub supply pipe 124 may comprise a passage that terminates at a lateral side of the tub 104, as shown in the example of FIG. 1. Alternatively the tub supply pipe 124 may connect to the bellows or seal (not illustrated) that connects the opening of the tub 104 to the casing 102. As another alternative, the supply pipe 124 may connect to a reservoir (not shown), where the incoming liquid solution accumulates and may be heated or agitated before being pumped via a separate pump (not shown) to the tub 104. In any case, the liquid solution may enter the tub 104 directly (e.g., enter through an outer wall of the tub 104), or indirectly (e.g., enter the tub 104 by way of the drum 106). Other alternatives and variations will be apparent to persons of ordinary skill in the art in view of the present disclosure.

The composition of the liquid solution passing through the tub supply pipe 124 preferably can selectively contain one of the products contained in the compartments of the drawer 118, or such liquid solution can be clean water (i.e. water without added products), depending on the phase of the washing program and user preferences. For example, in the initial phases of the washing program, the a liquid detergent solution may be conveyed into the tub 104 by the incoming water, while in other phases, such as during a rinsing phase, only water is conveyed into the tub 104.

A sump 126 may be provided at the bottom of the tub 104, to provide, among other things, a reservoir in which water and one or more products from the drawer compartments can mix and intermingle prior to being deposited on the laundry 108 in the drum 106. The volume of the sump 126 may be selected to completely hold an initial charge of the incoming liquid solution, but this is not strictly required. In the shown embodiment, the sump 126 is fluidly connected to a main outlet pipe 128, which leads to a filter 130. The filter 130 (which is optional), is provided to filter debris that might be harmful to the downstream pump or pumps from the liquid solution. Any suitable filter type may be used (e.g., paper, plastic or metal mesh, centrifugal, etc.).

The outlet of the filter 130 is connected to a first pipe 132 that leads to the inlet of a recirculation pump 134. The outlet of the recirculation pump 134 is connected to a recirculation pump outlet pipe 136 that leads back to the sump 126. Upon activation, the recirculation pump 134 draws liquid solution out of the sump 126 and then pumps it back into the sump 126, to thereby mix and homogenize the detergent with the water in the tub 104. A heater may also be provided in the sump 126 or elsewhere in the fluid system to heat water in the tub 104. This premixing of the liquid solution addresses, at least to some degree, a problem that might occur when the contents of the detergent supply system 114 are unevenly distributed into the incoming water (e.g., a high initial concentration of detergent in the water, followed by a lower subsequent concentration).

In another embodiment, the tub supply pipe 124 between the detergent supply system 114 and the tub 104 may include a reservoir that provides a mixing chamber in which water and one or more products from the drawer compartments can intermingle prior to being deposited in the tub 104. It is also envisioned that a further separate water supply pipe can be provided to bypass the sump 126 or any other mixing compartment. Such a water supply pipe can be used to exclusively supply clean water into the tub 104, when desired.

The outlet of the filter 130 is also connected to a second pipe 138, which leads to the inlet of a distribution pump 140. The outlet of the distribution pump 140 is connected a distribution pump outlet pipe 142 that leads to the tub 104. Upon activation, the distribution pump 140 conveys the liquid solution from the sump 126 to the tub, where the liquid solution mixes with the laundry 108. The distribution pump outlet pipe 142 preferably is positioned to effectively distribute the liquid solution throughout the laundry 108. For example, it may be located on a boot seal surrounding a drum closure door, or the like.

The outlet of the filter 130 is also connected to a water draining system that is configured to drain the liquid solution, e.g., dirty water or water mixed with washing and/or rinsing products and dirt, from the tub 104 and drum 106. For example, the water draining system may include a third pipe 144 that connects the outlet of the filter 130 to the inlet of a draining pump 146. The outlet of the draining pump 146 is fluidly connected to a main outlet pipe 148. Upon activation, the draining pump 146 conveys liquid solution from the sump 126 to the main outlet pipe 148. The main outlet pipe 148 is configured to be fluidly connected to a household draining pipe system (not illustrated).

The first pipe 132, second pipe 138 and third pipe 144 are shown as being fluidly separate from one another, but it will be appreciated that they may be fluidly connected as branches of a common fluid passage. It will also be appreciated that each of the pumps 134, 140, 146 may have its own separate filter or one or more may not have a filter. Also, the main outlet pipe 128 may be directly connected to the draining pump 144, rather than passing through the filter. Other alternatives and variations will be apparent to persons of ordinary skill in the art in view of the present disclosure.

The laundry washing machine 100 may be advantageously provided with one or more liquid level sensors 150 (schematically illustrated in FIG. 1) configured to sense or detect the liquid level inside the tub 104. The level sensor 150 may comprise, for example, a pressure sensor that is acted upon by the liquid in the tub 104 to provide a sensor signal indicative of the liquid level of the wash water and/or the foam level contained in the tub 104. In some cases, the pressure sensor may be fluidly connected with a draining sump of the water draining system.

The level sensor 150 also may comprise a mechanical, electro-mechanical, electrical, or optical fluid level measuring system, etc. Such devices are known in the art (e.g., floats, capacitance sensors, etc.) and need not be described in detail herein.

The laundry washing machine 100 also includes a control unit 152. The control unit 152 includes hardware and software configured to operate the laundry washing machine. In one example, the control unit 152 includes one or more processors that are programmed to execute machine-readable code stored on one or more memory devices. A typical processor may be a central processing unit (CPU), a microprocessor, an application-specific integrated circuit (ASIC), and so on. Memory devices may be provided as random access memory (RAM) for temporary data storage, read only memory (ROM) for permanent data storage, firmware, flash memory, external and internal hard-disk drives, and the like. The processor communicates with the memory device via a communication bus or the like to read and execute computer-readable instructions and code stored in a non-transient manner in the memory devices. The incorporation of control units into a laundry washing machines is well-known in the art and the details of the control unit 152 need not be explained in more detail herein.

The control unit 152 is operatively connected to the various parts of the laundry washing machine 100 in order to control its operation. The control unit 152 preferably is operatively connected to: the electric motor 110 so that the drum speed may be controlled, the controlled supply valves 120 so that the water supplied to the drawer 118 is controlled; and to the draining pump 146 to control the draining of liquid from the tub 104. The control unit also may be connected to the level sensor 150 to determine a level of water and/or foam inside tub 104, a load weight measuring system, one or more water temperature sensors, lockout switches (e.g., a switch that prevents operation if the loading/unloading door is opened), and so on. The control unit 152 also may be configured to perform unbalance laundry checks to verify whether the laundry 108 loaded in the drum 106 is balanced or not, and to perform various conventional operations.

The operative connections between the control unit 152 and the remaining parts may be by electrical wires, wireless communication, and the like. Suitable control devices (e.g., solenoids to operate valves, motor controllers, etc.) are provided to allow the control unit 152 to operate the various components. Conventional fuses, power converters, and other ancillary features also may be included as necessary or desired.

The control unit 152 is also operatively connected to a user interface 154 (schematically illustrated in FIG. 1) that is accessible to the user. The user interface 154 is configured to allow the user to select and set the washing parameters, for example by selecting a desired washing program. The user interface 154 also may be configured to allow the user to input other operating parameters, such as the washing temperature, the spinning speed, the load in terms of weight of the laundry to be washed, the type of fabric of the load, etc. The user interface 154 also includes, as part of a washing program or as a separately selectable feature or mode, the option to operate the laundry washing machine 100 in an operation program intended to address the presence of a large amount of dirt in the laundry heavy soil. This operation program is hereinafter referred to as a "solid soil" cycle, but this nomenclature is not intended to be limiting.

The user interface 154 may comprise any suitable arrangement of input and output mechanisms. For example, input may be provided by one or more dials, switches, buttons, touchscreens, touch points or the like, and output may be provided by one or more position markers, textual or graphic images, illuminable lights or displays, touchscreens, and so on. In one example, the user interface includes a power button, a rotatable operation program selection dial that selects among pre-set operation programs (e.g., sanitary cycle, light load, heavy load, etc.), and a number of operation program adjustment buttons that can be operated to modify aspects of the pre-set operation programs (e.g., temperature adjustment, time adjustment, spin speed adjustment, etc.).

Each pre-set operation program may include a cleaning plan having a sequence of cycles and one or more default variables associated with each cycle. For example, one cleaning program may include a tub loading cycle in which the supply valves 120 are operated for a predetermined length of time to load water and detergent into the tub 104, followed by a cleaning cycle in which the drum 106 is rotated for a predetermined length of time at a predetermined speed, followed by a draining cycle in which the draining pump 146 is operated for a predetermined length of time, followed by a spin cycle in which the drum 106 is rotated for a predetermined length of time at a predetermined speed. The particular times and speeds may be modified by user input. For example, the spin cycle speed may be decreased or increased. Any number of cycles and variables may be used for each pre-set operation program, such as: time and rotation speed of an intermediate spin to be performed at the end of a wash phase; number of rinse phases to be performed during the washing program; the amount of water to be supplied in the tub 104 during rinse phases; the number of intermediate spins to be performed at the end of each rinse phase; and so on.

The control unit 152 is configured to operate the various parts of the laundry washing machine 100 to effectuate the pre-set operation programs, and to make adjustments to these operation programs based on user input. The control unit 152 also may use sensor feedback to modify the cycles and variables for each pre-set operation program. For example, the control unit 152 may change the volume of water (typically controlled by valve operation time) used during a particular load cycle based on detecting a load weight above a certain value. As another example, the control unit 152 may reduce the spin speed of a particular spin cycle if a balance indicator (e.g., an accelerometer or the like) indicates excessive vibration. Other alternatives and variations will be apparent to persons of ordinary skill in the art in view of the present disclosure.

Figure 2:
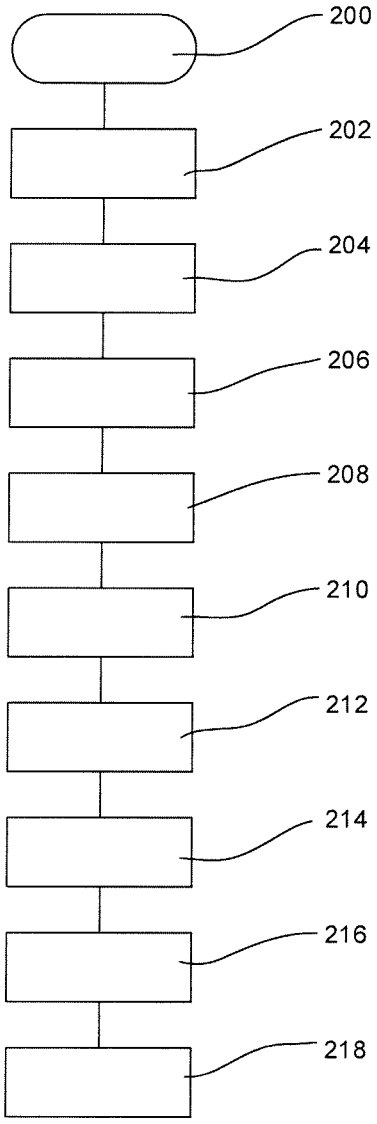
FIG. 2 is a flowchart of a first exemplary cleaning program.

FIG. 2 illustrates a prior art cleaning operation program in detail. The operation of FIG. 2 is exemplary of a prior art wash operation performed in washing machine that premixes the detergent in mixing chamber. In step 200, the control unit 152 receives input from the user interface 154 to perform an operation program. This operation program includes, in general terms, a tub loading process in which water and detergent are provided to the tub 104, a washing process in which the laundry is cleaned with the detergent, a rinsing process in which the wash solution is drained from the tub and replaced by rinses of other liquid solutions (e.g., clean water, bleach, fabric softener, etc.), and a final draining and spinning process in which the water is drained from the tub 104 and the laundry 108 is spun to remove at least a portion of remaining liquid solution.

The tub loading process begins in step 202, in which the control unit 152 activates one or more valves 120 for a period of time to allow a first volume of cold water to flow through a first compartment 114*a* in the detergent supply system 114 to entrain and carry away user-supplied detergent provided in the first compartment 114*a*. The first volume of water is a quantity of water sufficient to substantially fill the mixing chamber or sump 126, but not so much water that the water level in the tub raises above the lower side of the drum 104, e.g. the water level is below a wash level. The first volume of water may be controlled based on a set fill time, a flow meter in the fill line, and/or by a water level sensor as is well understood in the art. The load may optionally be wetted with clean water while the wash liquid is being mixed. Next, in step 204, the control system 152 closes the valves 120 to terminate water flow through the detergent supply system 114, and the liquid solution is pre-mixed in a mixing chamber or sump 126. For example, when the sump 126 portion of the tub 104 is employed as the mixing chamber, the sump recirculation pump 134 is activated to recirculate and stir the wash liquid in the sump 126. By mixing the wash liquid with a first amount of water in the tub 104 with water level below the drum 106, the detergent may be dissolved and substantially fully mixed with the water in the tub to homogenize the wash liquid before the wash load in the drum is wetted with the wash liquid.

In step 206, the control system 152 optionally activates one or more valves 120 to allow a second volume of water to pass therethrough. The second volume of water may also include additional detergent that may still be present in the first chamber 114*a*. The second volume of water mixes with the liquid solution created by the first volume of water, and the two volumes of water are conveyed to the tub 104 by a pump (e.g., draining pump 146 or the like). The second volume of water is a quantity of water sufficient raise the water level in the tub somewhat above the lower side of the drum 106 in order to wet the wash load in the drum with the wash liquid, e.g. the wash liquid is at a wash level. When the tub 104 is filled to an appropriate level, the control system 152 closes the valve 120.

It may not be necessary in all cases to perform step 206 to add additional water. The need to add additional water, and the amount of water to be added if necessary may be based, for example, on a measurement of water level using a pressure sensor 150 or other devices to evaluate or estimate the total volume of water in the tub 104. For example, the control system 152 may be programmed to add additional water to the tub 104 if the water level is not within a range of 30-90 millimeters of water on a pressure sensor scale. If that is the case, then step 206 may be performed to add a predetermined volume of water based on the particular cleaning cycle, the load size, the type of load, and other parameters.

The washing process begins at step 208, when the control system 152 activates a washing cycle. The washing cycle may include any suitable combination of idle soaking (i.e., soaking without agitation) and agitating (i.e. soaking with agitation) sequences. The load is agitated by activating the motor 110 to rotate the drum 106 at a low speed to tumble the load 108 in the drum 106, e.g. lift the load 108 out of the wash liquid and drop it back into the wash liquid. The time, direction and speed of agitation also may be varied during the course of the washing cycle. For example the washing cycle may alternate repeatedly between soaking with the motor 110 off, activating the motor 110 to rotate the drum 106 in one spin direction, and activating the motor 110 to rotate the drum 106 in the opposite spin direction (not necessarily in that order). In this example, the washing process is performed for 45 minutes, but other cycle wash times may be used.

The washing process is followed by a rinse and spin process, which includes two rinsing and two draining and spinning sequences. The exemplary rinsing process begins in step 210 when the control system 152 activates the draining pump 146 to drain the wash liquid from the tub 104, and activates the motor 110 to spin the drum 106 at a high speed to extract wash liquid from the load in the first drain and spin cycle. During this cycle, the control system 152 first operates the draining pump 146 to pump the free volume of liquid solution out of the tub 104 via the water draining system. The control system 152 then operates the motor 110 to spin the drum 106 at a high speed to extract wash liquid from the laundry 108, while continuing to operate the draining pump 146 to pump the wash liquid out of the tub 104. It will be understood that a certain amount of liquid will almost always remain in the tub 104, drum 106 and other parts of the laundry washing machine 100, even after rigorous spinning of the drum 106, because the laundry typically absorbs a portion of the liquid solution and some of the liquid solution may cling to or be trapped on surfaces without moving to the water draining system.

In step 212, the control system 152 activates a first rinse cycle by operating one or more valves 120 to fill the tub 104 with clean rinse water to an appropriate level. The first rinse may be a bleach cycle, in which the valves 120 are operated to direct water through a second compartment **114*b* in the detergent supply system 114 that is intended to contain user-supplied bleach. The first rinse cycle may, if desired, include a pre-mixing process, such as described in steps 202 through 204. The first rinse may alternatively be performed with clean water, e.g., without bleach. In this example, the total volume of water added during the first rinse cycle may be based, for example, on a measurement of water pressure within the tub 104**. For example, water may be provided to raise the water pressure to about 80 millimeters of water.

In step 214, the control system 152 then activates a second drain and spin cycle. During this cycle, the control system 152 once again operates the draining pump 146 to pump the free volume of the liquid out of the tub 104 via the water draining system, and then operates the motor 110 to spin the drum 106 to extract additional water from the laundry 108.

In step 216, the control system 152 activates a second rinse cycle by operating one or more valves 120 to fill the tub 104 to an appropriate level. The second rinse cycle may be a fabric softener cycle, in which the valves 120 are operated to direct water through a third compartment **114*c* in the detergent supply system 114 that is intended to contain user-supplied fabric softener. The second rinse cycle may, if desired, include a pre-mixing process, such as described in steps 202 through 204. The second rinse may alternatively be performed with clean water, e.g. without fabric softener. In this example, the total volume of water added during the second rinse cycle may be selected based on a pressure measurement or other variables. For example, the amount of water may be sufficient to raise the pressure in the pressure sensor 150** to 80 millimeters of water, and then add an additional five liters.

In step 218, the control system 152 performs the final draining process in the form of a third drain and spin cycle. During this cycle, the control system 152 once again operates the draining pump 130 to pump the free volume of the liquid solution out of the tub 104 via the water draining system, and operates the motor 110 to spin the drum 106 to remove additional water. At the end of the final draining process, the control system 152 may deactivate a door lock to allow user access to the drum 160, and activate the user interface 154 to indicate that the cleaning program is complete.

Figure 3:
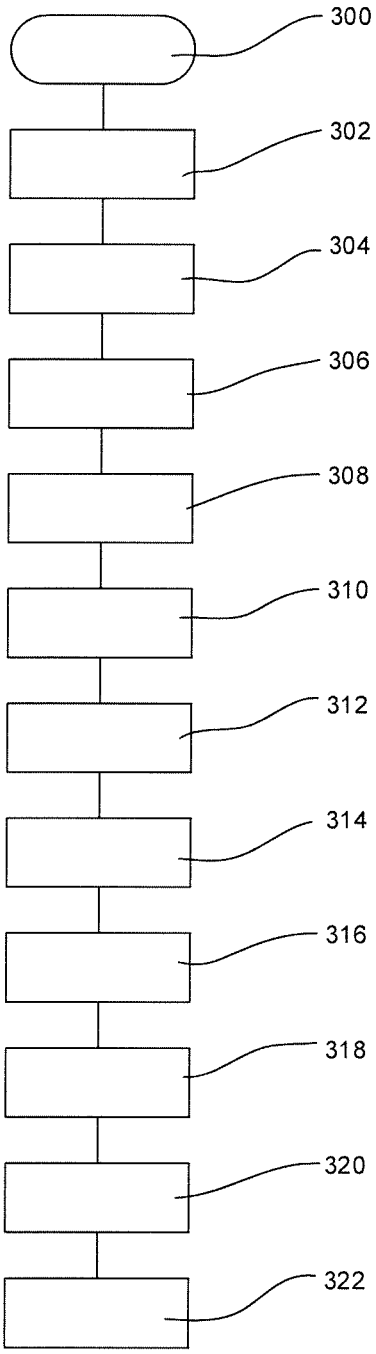
FIG. 3 is a flowchart of a second exemplary cleaning program.

FIG. 3 illustrates an exemplary second cleaning operation program according to the present invention in detail. The second cleaning operation program is similar to the first cleaning operation program of FIG. 2, but includes additional steps that have been discovered to provide significantly improved cleaning performance in situations in which the laundry has relatively large amounts of soil, particularly solid soil.

In step 300, the control unit 152 receives input from the user interface 154 to perform a solid soil operation program to provide enhanced cleaning performance. This may be accomplished using any selection or sequence of user inputs. For example, the user interface 154 may have a dedicated button or icon specifically for performing the solid cycle program (e.g., a button labeled "Solid Soil" or the like). As another example, the solid soil operation program may be activated when a user selects a pre-set program (e.g., a "Normal" wash program), and then modifies the program by a supplemental selection indicating a high soil level or that a more intensive version of the wash program is desired (e.g., selecting a "Solid Soil" option provided for the Normal wash program).

The tub loading process begins in step 302, in which the control unit 152 activates one or more valves 120 for a period of time to allow a first volume of water to flow through a first compartment **114*a* in the detergent supply system 114 to entrain and carry away user-supplied detergent provided therein. The first volume of water may be a quantity of water sufficient to substantially fill the mixing chamber or sump, but not so much water that the water level in the tub 104 raises into the lower side of the drum 106**, e.g. the water level is below a wash level. The first volume of water may be controlled based on a set fill time, a flow meter in the fill line, and/or by a water level sensor as is well understood in the art. The load is my optionally be wetted with clean water while the wash liquid is being mixed. The water used in this step may include hot water or be solely hot water, but cold water may also be used.

Next, in step 304, the control system 152 closes the valves 120 to terminate water flow through the detergent supply system 114, and the liquid solution is pre-mixed in a mixing chamber or sump 126. For example, when the sump portion of the tub is employed as the mixing chamber, the sump recirculation pump 134 is activated to recirculate and stir the wash liquid in the sump 126. By mixing the wash liquid with a first amount or water in the tub 104 with water level below the drum 106, the detergent may be dissolved and substantially fully mixed with the water in the tub 104 to form a homogenized wash liquid before the wash load 108 in the drum 106 is wetted with the wash water.

In step 306, the control system 152 again activates one or more valves 120 to allow a second volume of water to pass therethrough. The second volume of water may also include detergent or the like. The second volume of water mixes with the liquid solution created by the first volume of water, and the two volumes of water are conveyed to the tub 104 by a pump, system water pressure, gravity, or other means. Alternatively, the first volume of water may be directed to the tub 104 before the second volume. The second volume of water is a quantity of water sufficient raise the water level in the tub 104 somewhat above the lower side of the drum 106 so that the wash liquid enters the drum 106 by the perforations or holes in the drum 106. Thus, the wash liquid wets the wash load in the drum with the wash liquid, and the wash liquid is at a wash level. When the tub 104 is filled to an appropriate level (which may be fixed or based on load size, other user selections, etc.), the control system 152 terminates step 306.

It may not be necessary in all cases to perform step 306 to add additional water. The need to add additional water, and the amount of water to be added if necessary may be based, for example, on a measurement of water level using a pressure sensor 150 or other devices to evaluate or estimate the total volume of water in the tub 104. For example, the control system 152 may be programmed to add additional water to the tub 104 to add water until the pressure of the water in the tub 104 reaches a value of 125 millimeters of water on a pressure sensor scale. The specific amount of water might vary depending on the load size and type of load in the drum 106. The total volume of water added during the tub loading process of step 306 optionally may be higher than a conventional amount. For example, the pressure sensor value may be selected to be higher than the sensor value that is used to load water in a other cleaning cycles in the same machine (e.g., 125 mm vs. 30-90 mm). Other alternatives and variations will be apparent to persons of ordinary skill in the art in view of the present disclosure.

The control system 152 begins the washing process in step 308, by beginning the washing cycle. The washing cycle may include any suitable combination of idle soaking and agitating sequences. The time, direction and speed of agitation also may be varied during the course of the washing cycle, such as explained above in relation to the process in FIG. 2, however, the total time selected for the washing cycle may be increased to provide improved cleaning. For example, rather than washing for 45 minutes as explained above, the control system 152 may perform the washing cycle for 55-60 minutes.

A static rinsing and draining process begins after or at the end of the washing process. In step 310, the control system 152 activates a water drain cycle. During this cycle, the control system 152 activates the draining pump 146 to pump the free volume of liquid solution out of the tub via 104 the water draining system. In a preferred embodiment, the motor 110 is not operated to spin the drum 106 while the liquid solution is draining in step 310.

After the foregoing static water drain cycle completes, the control system 152 may perform a second static water drain cycle (not illustrated) by refilling the tub 104 to a predetermined level with water (preferably cold water), and then once again operating the draining pump 146 to remove the free volume of liquid from the tub 104. As before, the motor 110 is not operated to rotate the drum 106 (or its operation is delayed as discussed above) during this second static water drain cycle. This second static water drain cycle is optional, but may be helpful to remove excessive amounts of dirt.

As or after the final static rinse cycle completes, the control system 152 initiates a first rinse cycle at step 312. During this cycle, the control system 152 opens one or more valves 120 to fill the tub 104 with water, preferably to a relatively high level within the tub 104 (e.g., a level that is higher than a typical rinse, drain and spin cycle, such as to 125 millimeters of water instead of 30-90 millimeters or water for other cycles of the same machine). The water provided in this step preferably is clean, but it may include additives such as bleach, fabric softener, or the like.

Other rinsing processes may continue after the static rinsing process. For example, in step 314 the control system 152 activates a first drain and spin cycle, such as described above in relation to FIG. 2. During this cycle the control system 152 operates the draining pump 146 to pump the free volume of liquid solution out of the tub 104 via the water draining system, then operates the motor 110 to spin the drum 106.

In step 316, the control system 152 activates a second rinse cycle by operating one or more valves 120 to fill the tub 104 to an appropriate level. For example, water may be added until the pressure sensor 150 reads about 80 millimeters of water during the second rinse cycle. The second rinse cycle preferably is a bleach cycle, in which the valves 120 are operated to direct water through a second compartment 114*b* in the detergent supply system 114 that is intended to contain user-supplied bleach. However, this is not strictly required, and this cycle may be performed with clean water or other additives. This rinse cycle also may include a pre-mixing process, such as described above.

In step 318, the control system 152 activates a second drain and spin cycle, such as described above in relation to FIG. 2. During this cycle the control system 152 operates the draining pump 146 to pump the free volume of the liquid solution out of the tub 104 via the water draining system, then operates the motor 110 to spin the drum 106.

In step 320, the control system 152 activates a third rinse cycle by operating one or more valves 120 to fill the tub 104 to an appropriate level. For example, water may be added until the pressure sensor 150 reads about 80 millimeters of water, and then further operate to add an additional five liters of water during the third rinse cycle. The third rinse cycle may be a fabric softener cycle, in which the valves 120 are operated to direct water through a third compartment 114*c* in the detergent supply system 114 that is intended to contain user-supplied fabric softener. However, this is not strictly required, and the third rinse cycle may instead use clean water or other additives provided in the detergent supply system 114. The third rinse cycle may, if desired, include a pre-mixing process, such as described above.

In step 322, the control system 152 performs the final draining process by activating a third drain and spin cycle. During this cycle, the control system 152 once again operates the motor 110 to spin the drum 106 at a predetermined speed or selection of speeds, and operates the draining pump 146 to pump the free volume of the liquid solution out of the tub 104 via the water draining system, such as described above.

At the end of the third drain and spin cycle, the control system 152 may deactivate a door lock to allow user access to the drum 160, and activate the user interface 154 to indicate that the cleaning program is complete.

Figure 4:
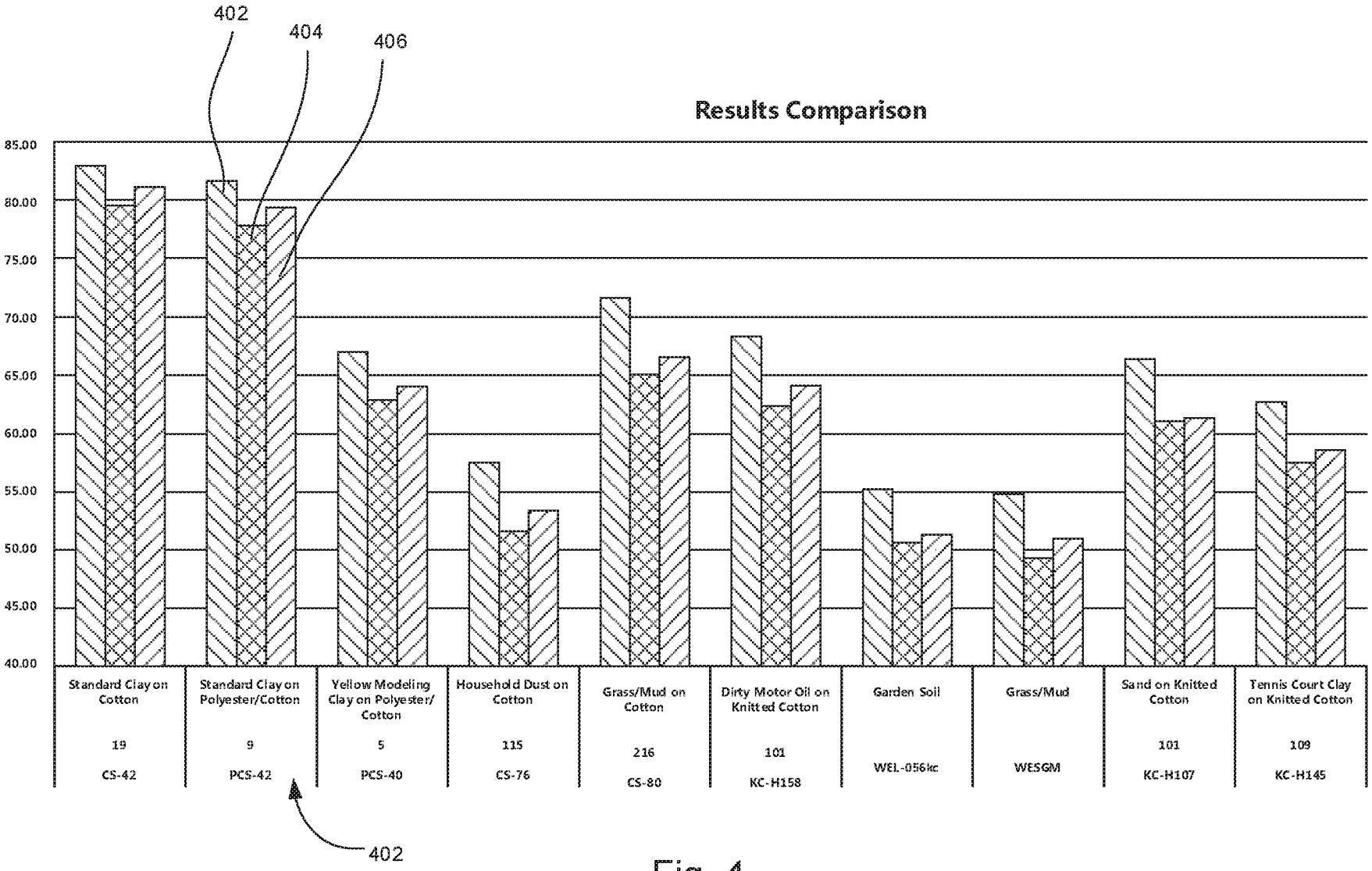
FIG. 4 is a comparison chart illustrating dirt removal performance using three different cleaning programs.

It has been found that the process of FIG. 3 can provide significantly better performance at removing large volumes of soil, particularly solid soil, from laundry. For example, FIG. 4 illustrates a graphical comparison of dirt removal performance for three different cleaning programs. The illustration provides the results for ten different tests. Each test is identified by a test name 400, and the results of each test are indicated by a vertical bar representing each of the three cleaning programs. For each test, the leftmost bar 402 represents test results for the process described in relation to FIG. 3, and the rightmost bar 406 represents test results for the process described in relation to FIG. 2. Except as otherwise noted above, these two cleaning programs were conducted using identical operational parameters. The middle bar 404 provides test data for a third alternative cleaning program provided by a commercially available laundry washing machine.

The height of each bar (i.e., the Y-axis value) represents the reflectance of the test sample at the end of three successive cleaning operations. A higher reflectance indicates that less dirt is retained by the sample, and therefore a higher reflectance value correlates to higher cleaning performance. Each group of three bars compares test results indicating how three different cleaning cycles performed at removing a particular kind of solid soil. For example, in the "standard clay on cotton" test, the test sample used in the first cleaning program 402, which corresponds to the process similar to that described in relation to FIG. 3, had an absolute reflectance of about 83.00, as compared to about 79.00 for a dirt cleaning cycle provided by a commercially available machine, and an absolute reflectance value of about 77.00 for the process described in relation to FIG. 2. As can be seen from this data, the cleaning program described in relation to FIG. 3 yielded higher reflectance values for each of the tests, thus demonstrating significantly better dirt-removing capability.

Without being limited to any particular theory of operation, it is believed that the enhanced performance of the process of FIG. 3 is due to various factors. First, the use of hot water during the initial tub loading process (step 302) can be helpful to help break or free particular soils from the fabric by providing a hot concentration of water and detergent to the laundry at the beginning of the wash before other liquid is added in the subsequent tub loading step (i.e., step 306). Second, the increased water level during the washing process (step 308) is expected to contribute to the enhanced results by suspending particulates at a higher level of water to help separate them from the laundry. Also, the additional duration of the washing process (308) is expected to provide more time to separate large volumes of dirt from the laundry. Third, the static rinse process of draining the wash water (step 310) and adding new water (step 312), without the usual spinning of the drum 106 as normally would be done in a post-wash drain and spin step (e.g. step 210 in FIG. 2), is expected to help separate dirt from the laundry because the spinning action is not there to compress the laundry and dirt together. Fourth, the use of a relatively large volume of water in the static rinse process is expected to help the dirt separate from the laundry during the subsequent draining and spinning process (step 314), which is expected to help the dirt drain out of the drum 106 without becoming redeposited into the laundry 108.

It is believed that the foregoing factors all contribute in a synergistic way to achieve significantly improved cleaning performance. However, it is also believed that individual contributions of each factor can be significant on their own. For example, in some alternative embodiments, hot water may be omitted in step 302 and/or a conventional volume of water may be added during the tub loading process. As another alternative embodiment, the draining process (step 310) that precedes the addition of the static rinse water (step 312) may include a nominal amount of slow drum spinning, provided the laundry is not agitated to the point where it re-entraps a significant amount of released dirt. As still another alternative embodiment, the water level during the wash cycle 308 may be at a relatively high value, and the static rinse process may be omitted. Other alternatives and variations will be apparent to persons of ordinary skill in the art in view of the present disclosure.

It will be appreciated that the steps and cycles described in the foregoing cleaning programs can be modified in various ways. For example, steps 302 through 306 may be omitted and replaced by a conventional loading cycle in which the control system 152 opens a valve 120 to pump water through the detergent supply system 114 and directly into the tub 104. Also various steps may be operated on overlapping schedules; for example, step 308 may begin before step 306 ends, or step 310 may begin before step 308 ends. Furthermore, although it has been found to be beneficial to add the static rinse cycle immediately after the washing process, it also may be beneficial to move the static rinse cycle to follow one or both of the steps in the rinsing process (e.g., after step 316 or 320). As still another example, the static rinse process may be combined with one or both of the other rinsing processes, such as by omitting the drum rotation from step 314 or 318 (and possibly increasing the volume of added water). Other alternatives and variations will be apparent to persons of ordinary skill in the art in view of the present disclosure.

Embodiments of the inventions described by example herein can be implemented in various forms. For example, in one aspect, an embodiment of the invention may be implemented as a method for performing a cleaning program. In another aspect, an embodiment of the invention may be implemented as a laundry washing machine that is programmed to perform a cleaning program. In still another aspect, an embodiment of the invention may be implemented as a set of computer-readable instructions for performing a cleaning program that are stored in a non-transient format that can be integrated into an essentially generic laundry cleaning device. Other alternatives and variations will be apparent to persons of ordinary skill in the art in view of the present disclosure.

The present disclosure describes a number of inventive features and/or combinations of features that may be used alone or in combination with each other or in combination with other technologies. The embodiments described herein are all exemplary, and are not intended to limit the scope of the claims. It will also be appreciated that the inventions described herein can be modified and adapted in various ways, and all such modifications and adaptations are intended to be included in the scope of this disclosure and the appended claims.

The invention claimed is:

1. A method for controlling a laundry washing machine having a tub, a drum rotatably mounted within the tub, a motor configured to selectively rotate the drum, one or more supply valves connectable to a water supply system, a detergent supply system and a water draining pump, the method comprising:

performing a tub loading process comprising operating the one or more supply valves to provide a first volume of water through the detergent supply system and into the tub to fill the tub with wash liquid;

performing a washing process comprising operating the motor to rotate the drum to thereby agitate laundry in the drum in the presence of the wash liquid;

performing a static rinsing process comprising operating the water draining pump to remove an entire free volume of wash liquid from the tub without operating the motor to spin or rotate the drum; and performing one or more rinsing processes comprising:

performing a tub loading process comprising operating the one or more supply valves to provide a volume of clean rinse water to the tub, operating the water draining pump to remove the rinse water from the drum, and operating the motor to spin the drum at high speed to extract rinse water from the laundry, while continuing to operate the draining pump.

2. The method of claim 1, wherein the one or more rinsing processes further comprise:

operating the motor to rotate the drum after the step of performing the tub loading process and before the step of operating the water draining pump.

3. The method of claim 1, wherein the one or more rinsing processes comprise:

presenting to a user an option to select between a first operating program and a second operating program;

receiving a user selection of the first operating program;

performing a tub loading process comprising operating the one or more supply valves to provide a first volume of clean rinse water to the tub, the first volume being greater than a volume used in a tub loading process for the second operating program;

operating the water draining pump to remove rinse water from the drum;

operating the motor to spin the drum at high speed to extract rinse water from the laundry, while continuing to operate the draining pump; and performing a further one or more rinsing, draining and spinning processes.

4. The method of claim 1, wherein the one or more rinsing processes comprise:

presenting to a user an option to select between a first operating program and a second operating program;

receiving a user selection of the first operating program;

performing a tub loading process comprising operating the one or more supply valves to provide a first volume of clean rinse water to the tub that is greater than a volume used in a tub loading process for the second operating program;

operating the motor to rotate the drum and agitate the load for a period of time;

operating the water draining pump to remove rinse water from the drum;

operating the motor to spin the drum at high speed to extract rinse water from the laundry, while continuing to operate the draining pump; and performing a first further one or more rinsing, draining and spinning processes.

5. The method of claim 1, wherein the one or more rinsing processes comprise:

presenting to a user an option to select between a first operating program and a second operating program;

receiving a user selection of the first operating program; and wherein at least one of the one or more rinsing processes comprises operating the one or more supply valves to provide a first volume of clean rinse water to the tub that is greater than a volume used in a tub loading process for the second operating program.

6. The method of claim 1, wherein operating the one or more supply valves to provide a first volume of water through the detergent supply system and into the tub to fill the tub with wash liquid comprises mixing the wash liquid in a chamber before conveying the wash liquid to the tub.

7. The method of claim 1, wherein performing the tub loading process further comprises: operating the one or more supply valves to provide a second volume of water through the detergent supply system and into the tub to fill the tub and at least a portion of the drum with wash liquid.

8. The method of claim 7, wherein the second volume of water comprises hot water.

* * * * *